7/5/83 XR 4,392,080

United States Patent [19]

Maschke

[11] 4,392,080

[45] Jul. 5, 1983

[54] MEANS AND METHOD FOR THE FOCUSING AND ACCELERATION OF PARALLEL BEAMS OF CHARGED PARTICLES

[75] Inventor: Alfred W. Maschke, East Moriches, N.Y.

[73] Assignee: The United States of America as represented by the United States Department of Energy, Washington, D.C.

[21] Appl. No.: 152,461

[22] Filed: May 23, 1980

[51] Int. Cl.[3] ..... H01J 25/10

[52] U.S. Cl. ..... 315/5.41; 315/3; 315/5; 315/5.35; 250/396 R; 328/233; 313/414

[58] Field of Search ..... 315/5.41, 5.42, 5.35, 315/3, 5.3; 330/4.7, 4.6; 328/233; 313/414; 250/396 R

[56] References Cited

U.S. PATENT DOCUMENTS

| | | | |
|---|---|---|---|
| 2,932,749 | 1/1976 | Taylor | 328/233 |
| 3,147,445 | 9/1964 | Wuerker et al. | 315/3 X |
| 3,205,449 | 9/1965 | Udelson | 330/4.7 |
| 3,500,108 | 3/1970 | Poeschl et al. | 315/3 |
| 3,562,683 | 2/1971 | Santis et al. | 315/5.35 |
| 3,651,417 | 3/1972 | Bogomolov | 315/5.41 |
| 3,886,399 | 5/1975 | Symons | 328/233 |
| 4,211,954 | 7/1980 | Swenson | 315/5.41 |

*Primary Examiner*—Saxfield Chatmon, Jr.

[57] ABSTRACT

A novel apparatus and method for focussing beams of charged particles comprising planar arrays of electrostatic quadrupoles. The quadrupole arrays may comprise electrodes which are shared by two or more quadrupoles. Such quadrupole arrays are particularly adapted to providing strong focussing forces for high current, high brightness, beams of charged particles, said beams further comprising a plurality of parallel beams, or beamlets, each such beamlet being focussed by one quadrupole of the array. Such arrays may be incorporated in various devices wherein beams of charged particles are accelerated or transported, such as linear accelerators, klystron tubes, beam transport lines, etc.

19 Claims, 5 Drawing Figures

MEANS AND METHOD FOR THE FOCUSING AND ACCELERATION OF PARALLEL BEAMS OF CHARGED PARTICLES

BACKGROUND OF THE INVENTION

The U.S. Government has rights in this invention pursuant to Contract Number De-AC02-76CH00016 between the U.S. Department of Energy and Associated Universities, Inc.

This invention relates to an apparatus and method for focusing beams of charged particles and particularly to an apparatus for focusing a plurality of parallel beams of charged particles. It relates still more particularly to a novel linear accelerator adapted to accelerate a plurality of parallel beams of charged particles.

Linear accelerators, or Linacs, are devices which use radio frequency energy to accelerate charged particles such as electrons, protons and ions. FIG. 1 shows a schematic illustration of the basic operating principles of one type of Linac.

The charged particles from ion source 2 enter at the left of drift tube 10 at a given velocity, the length of drift tube 10 being chosen so that as particles emerge the phase of the radio frequency (RF) voltage provided by source 20 is such that the particles are accelerated towards drift tube 12. After the particles are accelerated across the gap between drift tubes 10 and 12, they enter drift tube 12 where they are again shielded from the effects of the RF voltage. Drift tube 12 is similarly designed so that as the particles emerge the phase of the radio frequency voltage is again such as to accelerate the particles towards drift tube 13. This process is repeated again between drift tubes 13 and 14 and for as many additional sections as are necessary to achieve the desired particle energy. It should be noted that the lengths of the drift tubes increase as necessary to compensate for the increasing velocity of the particles so that the time required for the particles to travel, distance d from the center of one gap to the center of the next is always approximately ½ the period of the RF voltage. In the prior art means (not shown) are provided for generating focusing forces acting on the particle beam so as to counteract its tendency to diverge. Such means might be either electrostatic or electromagnetic in nature, but typically were electromagnetic. Also in the prior art means 4 were provided to initially accelerate the charged particles so that they would enter the Linac at the design injection velocity. Typically, an accelerator of the type known as a Cockcroft-Walton was used as the preaccelerator. A description of the prior art preaccelerators is not necessary to an understanding of the present invention, except to note that such preaccelerators were expensive and complicated. Buncher means 6 to bunch the particles so that they would enter the Linac at the proper phase of the RF voltage were also known in the prior art.

Prior art Linacs were also provided with a vacuum system 6, for maintaining the vacuum necessary for the acceleration of the beam.

It is obvious from inspection of FIG. 1 that a Linac is inherently a constant current device (i.e., the output current at time t is essentially equal to the input current at time t-T, where T is the transit time of the Linac). Therefore, to increase the output current it is necessary to increase the input current. However, for a given focusing force strength, the current density is limited by the space charge effect (i.e., the mutual repulsive forces between the charged particles). It may be shown that this space charge effect decreases with increasing energy of the particles. It is for this reason that a preaccelerator is used in the prior art to give the initially injected particles substantial energy so as to reduce space charge effect and increase the achievable input current to the Linac without the need to increase the physical size of the Linac.

There is, however, another important parameter for Linac beams, "brightness" or six dimensional phase space density. (The concept of "brightness" is well understood by those skilled in the art linear accelerator design and may be considered for our purposes to be a parameter which increases with increasing current density and decreases with an increasing tendency for the beam to diverge after it leaves the Linac.) Unfortunately, it may also be shown that the maximum possible "brightness" decreases with increasing injection energy. This unfortunate tradeoff has acted as a constraint on the production of high current, high brightness Linacs which would be extremely desirable for applications such as heavy ion fusion. Further, the limitations of preaccelerator technology have acted as a limitation on the achievable current density for Linacs without regard to brightness.

Referring again to FIG. 1 and the above discussion, it will be evident that the total length of a Linac is inversely proportional to the operating frequency of the RF potential. Obviously, other things being equal, it would be desirable to operate a Linac at a high frequency. However, another effect limits the use of high frequency in a Linac. Since particles require a finite time to cross the accelerating gaps it is necessary as the frequency is increased to reduce the gap distance since otherwise variations in the potential seen by particles entering the gap at slightly different times will cause excessive longitudinal dispersions in bunches of particles. However, the extent to which the gap size may be reduced is limited though by a relationship (which is well known to those skilled in the accelerator art) which shows that the diameter of the aperture of the drift tubes must be less than or approximately equal to the gap length. Since current density is limited by space charge, with a reduction in gap length there is a necessary reduction in aperture size and thus in the maximum current which may be accelerated. Thus, high current, high power accelerators tend to be extraordinarily large devices, in extreme cases reaching lengths of more than a mile.

It should be noted that other types of Linacs exist, differing in various details from the type illustrated. These details, however, do not affect the focusing problems discussed and the focusing apparatus of this invention could readily be adapted to such other types of Linac.

It is also known that space charge effects occur in other types of apparatus where beams of charged particles are transported, whether with or without acceleration. It is within the contemplation of this invention that the focusing apparatus of the invention may be used in such other types of apparatus, which include but are not limited to, DC accelerators, klystron tubes, beam transport lines and mass spectrometer or separation apparatus. Each of these types of apparatus, as well as others not discussed, comprise means for the transport of focused beams of charged particles and may benefit from the application of the principles of this invention and incorporation of the focusing apparatus of the invention.

Thus, it is an object of the present invention to provide a novel type of focusing apparatus which will provide beams approaching maximum brightness and which will focus beams having essentially any desired total current without increasing the strength of the focusing forces.

It is another object of the present invention to provide a Linac which will accelerate beams approaching maximum brightness and where total current is not constrained by the space charge effect.

It is another object of the present invention to provide a linear accelerator which does not require a preaccelerator.

It is still another object of the present invention to provide a linear accelerator which, for a given current, may operate at a higher frequency than heretofore achievable.

Other objects and advantages of the present invention will be obvious to those skilled in the linear accelerator art from the discussion and description given below.

BRIEF SUMMARY OF THE INVENTION

The above and other disadvantages of the prior art are overcome in the present invention by means of a novel focusing apparatus adapted to focus a plurality of small beams or "beamlets." This apparatus comprises a planar array of electrostatic quadrupoles suitable for applying strong focusing forces to a plurality of parallel "beamlets." By electrostatic quadrupole herein is meant an assembly of four electrodes, their centers being on the circumference of a circle and separated by 90°, each of the electrodes being connected to a DC potential, the polarity of that potential being the same for opposing pairs of electrodes and opposite for adjacent pairs of electrodes. The concept of strong focusing is well known to those skilled in the accelerator art and for our purposes may be considered as a means of focusing wherein the major components of the forces developed by the focusing device are restoring forces in one direction orthogonal to the beams and anti-restoring forces in the other orthogonal direction so that a strong net focusing effect may be achieved by alternating focusing devices of opposite polarities.

Thus, the present invention provides a method for focusing parallel beams of charged particles by providing regions of fields suitable for applying strong focusing forces to parallel beams of charged particles; the direction of the fields being reversed in alternate regions.

The above described arrays are then incorporated into drift tube assemblies by mounting the quadrupole array within means for shielding said array so that particles within said means are unaffected by the RF accelerating field. The shielding means may comprise two conductive plates each provided with a plurality of holes aligned with the apertures of the quadrupoles. The shielding means extend sufficiently beyond the array so that the volume between plates containing the array is shielded from external RF fields and the distance between the plates is appropriately chosen so that the assembly may function as a drift tube for the plurality of parallel beamlets contemplated by the present invention. (Hereinafter the term "drift tube" will be used as an equivalent for the term "drift tube assembly".)

A linear accelerator may then be made which comprises a plurality of such drift tubes mounted and aligned within a vacuum vessel. The lengths of, and spacing between, of the drift tubes being appropriately chosen, by means well known to those skilled in the linear accelerator art; means for generating an RF accelerating field between drift tubes being provided; and the quadrupoles of each drift tube assembly being connected to a source of DC focusing voltage, the DC polarities of alternate quadrupole arrays being reversed.

It is a particular advantage of the subject invention that electrostatic quadrupoles are inexpensive both to build and to operate when compared to magnetic quadrupoles. Additionally, in an embodiment described more fully below, the number of electrodes in the array of the invention is essentially equal to only twice the number of quadrupoles for large arrays. Thus, large arrays, which imply large total currents, may be constructed and operated economically.

It is a further advantage that in use charged particles may be injected into the Linac of the present invention with no more energy required than that which is needed to extract particles from the source. Still further, the RF gaps between drift tubes may be made as small as desired, so long as the potential gradient between drift tubes is not great enough to cause breakdown, and the Linac operated at higher frequencies than have theretofore been practicable. While both increasing the brightness and/or the frequency will tend to reduce the current in a particular beamlet, the total current in the Linac may be raised to any desired level merely by increasing the number of quadrupoles in the quadrupole array and thus increasing the number of beamlets.

It should be further noted that the Linac of the present invention is inherently suited to operate with modern efficient sources of charged particles where the particles are extracted from the source through a plurality of apertures since each aperture of the source may be associated with a particular beamlet of the subject Linac.

DETAILED DESCRIPTION OF THE INVENTION

Figure 1:
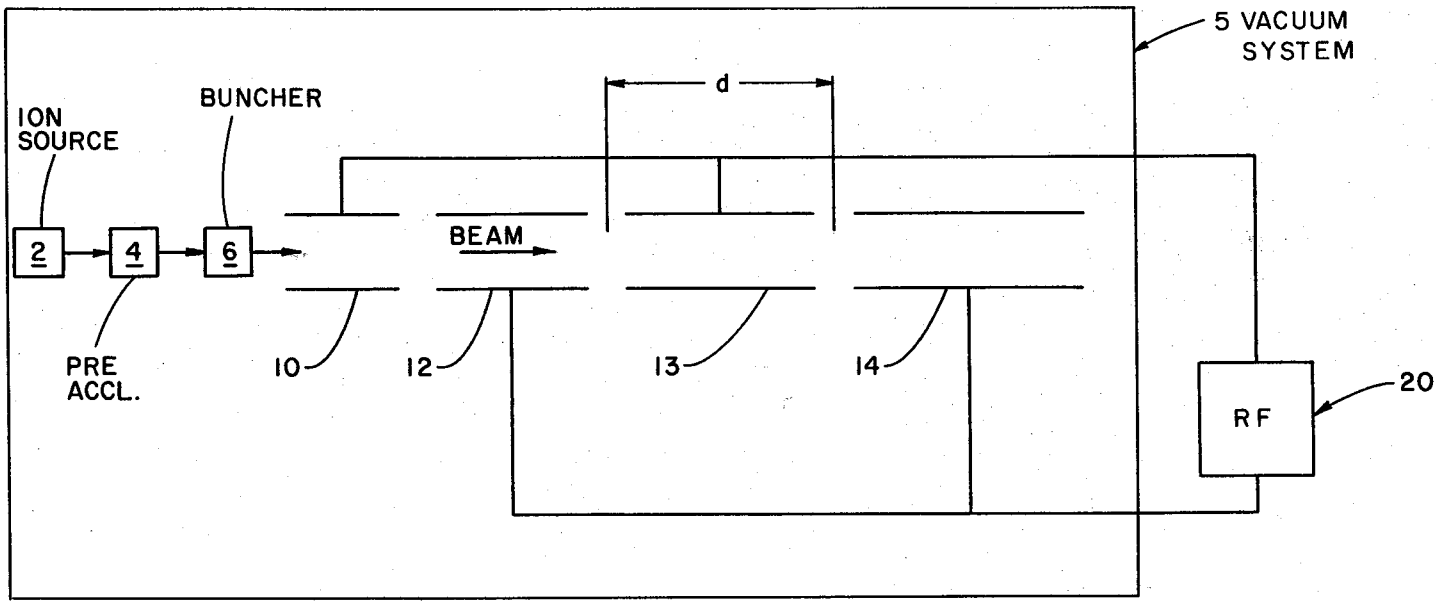
PRIOR ART Fig. 1
FIG. 1 is a schematic representation illustrating the basic operating principles of one type of Linac.
Figure 2:
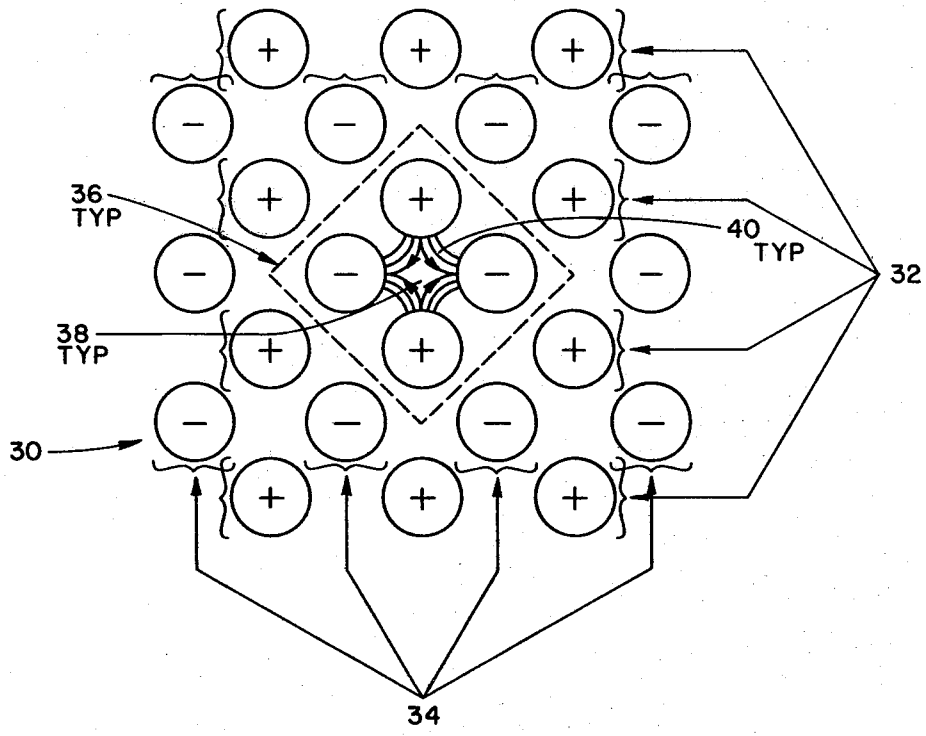
FIG. 2 is a schematic representation of a planar array of electrostatic quadrupoles showing the relative polarities of the electrodes and the electrostatic lines of force in a particular quadrupole aperture.

Referring to FIG. 2 there is shown a schematic representation of a planar array 30 of electrostatic quadrupoles 36. Array 30 comprises a first plurality of electrodes 32 having a DC potential of one polarity, shown as positive, and a second plurality of electrodes 34 having an opposite DC polarity. It is preferred that electrodes of pluralities 32 and 34 in general function as electrodes in more than one of quadrupoles 36. In a compact configuration a square array of $N^2$ quadrupoles may be formed from $2(N^2+N)$ electrodes, $(N^2+N)$ electrodes 32 carrying a DC potential of one polarity and ($N^2+N$) electrodes 34 carrying the opposite polarity.

The four electrodes which comprise each of quadrupoles 36 define an apertures 38 which are preferably approximately equal in diameter to the diameters of the electrodes. Within apertures 38 lines of force 40 illustrate the direction of the net force which would be felt by a charged particles within apertures 38. For the polarities illustrated in FIG. 2 and assuming a positively charged particle it may readily be seen that a particle which is vertically displaced from the center of an aperture 38 would experience a strong restoring force tending to move it towards the center of the aperture 18. A positive particle displaced in a horizontal direction, however, would experience a strong antirestoring force. As was discussed above, it is well known to those skilled in the accelerator art that by alternating focusing devices, such as the planar array of electrostatic quadrupoles shown, which have opposite polarities with respect to each other, a strong net focusing effect may be achieved on a particle beam. What is missing from the prior art is any realization that a single structure may be used to focus a plurality of parallel beams or beamlets and thereby achieve the objectives discussed above.

Figure 3:
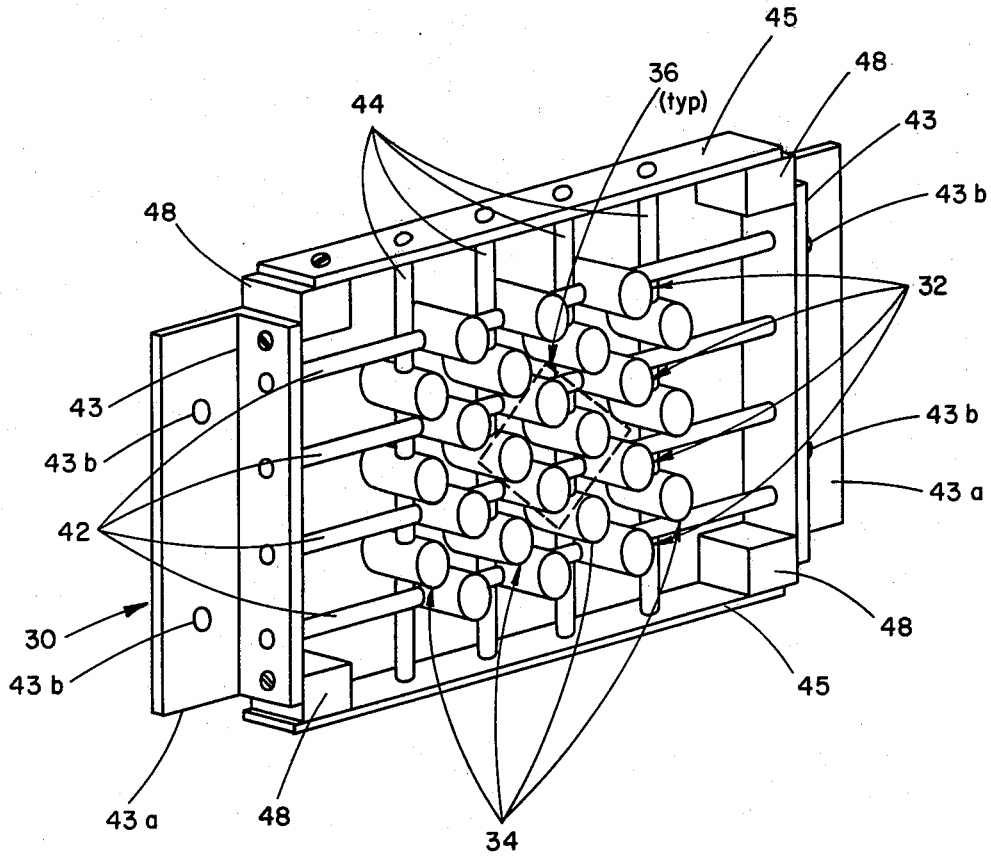
FIG. 3 is an isometric drawing of a planar array of electrostatic quadrupoles.

Referring now to FIG. 3 there is shown an embodiment of the planar array of the electrostatic quadrupoles schematically illustrated in FIG. 2. Array 30 comprises a square array of 9 electrostatic quadrupoles 36. It further comprises a first plurality of the electrodes 32 having a first DC polarity and a second plurality equal in number to the first plurality having the opposite DC polarity. Each electrode of the first plurality 32 is mounted, in groups of 3 with appropriate spacing, along horizontal rods 42. Rods 42 are formed with a conductive material and are mounted equally spaced and parallel in conducting terminal blocks 43. The second plurality of electrodes 34 is similarly mounted to vertical rods 44 which are in turn similarly mounted in conducting terminal blocks 45. Rods 42 and 44 are spaced from each other and terminals 43 and 45 are fastened by insulating blocks 48 to form a planar array of electrostatic quadrupoles. The electrodes of pluralities 32 and 34 are pinned or otherwise conductively fastened to rods 42 or 44 respectively so that their axes are parallel to the direction of the beamlets. Electrical connection to the first and second plurality of electrodes 32 and 34 is made through terminals 43 and 45.

Terminals 43 are provided with tags **43*a* having alignment holes 43*b* to allow for the proper alignment of array 30**.

The construction illustrated in FIG. 3 is advantageous in that an individual connection is not required for each electrode nor is an individual mounting insulator. It is a further advantage that insulators 48 are mounted well away from paths of the beamlets where they are not subject to radiation damage or coating by stray particles.

Other structures for forming the arrays of the subject invention may prove to be advantageous. It is anticipated that improved arrays may be developed using electrodes of various shapes (e.g., planar or cylinders with elliptical cross-sections). Using such shapes it would be possible to decrease the total array area at the possible cost of less ideal fields within the array apertures.

It is also contemplated that the quadrupole array of the present invention may be formed from just two components each comprising a metal plate having a plurality of apertures and projections. On one plate a plurality of projection would be formed adjacent to the apertures and positioned as verticle electrodes. On the other plate similar projections would be positioned as horizontal electrodes. (Note: such plates may be identical but rotated with respect to each other.) By mounting such plates in line, insulated from each other, with the projections intermeshed, a plurality of quadrupoles may be formed.

Such components could be inexpensively machined or cast. This is expected to be particularly advantageous, since it is anticipated that the advantages of the present invention may best be achieved by arrays having large numbers of relatively small quadrupoles. Further, the number of quadrupoles per unit area is approximately doubled since the quadrupoles of opposite polarity, which are blocked by rods 42 and 44 in the design shown in FIG. 3, are available.

Figure 4:
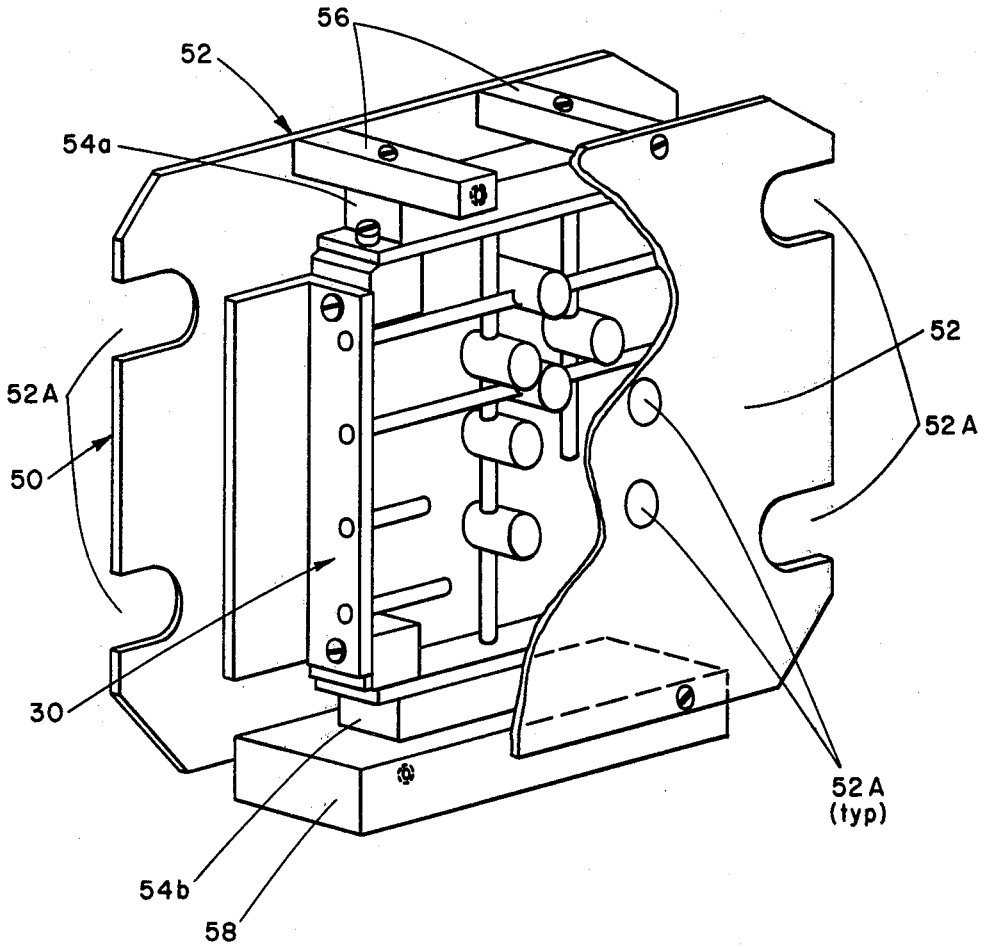
FIG. 4 is an isometric drawing, partially broken away, of a drift tube assembly.

Turning now to FIG. 4 there is shown a drift tube 50 according to the present invention.

Drift tube 50 comprises an array 30 mounted between conducting plates 52 by connection to insulators **54*a* and 54*b* fastened to spacers 56 and block 58 which function to hold plates 52 parallel and aligned and are sized so that spacing between plates 52 is appropriate. Block 58 also functions to electrically connect plates 52 to RF ground. Where drift tube 50 is to be connected to the RF buss (described below) block 58 is replaced by a second pair of spacer 56**.

Plates 52 have a plurality of holes **52*a* which are aligned with and equal in number to apertures 38 of array 30, and which allow passage of the beamlets. Plates 52 also have notches 52*b*** to allow passage of alignment rods which will be further described below.

Figure 5:
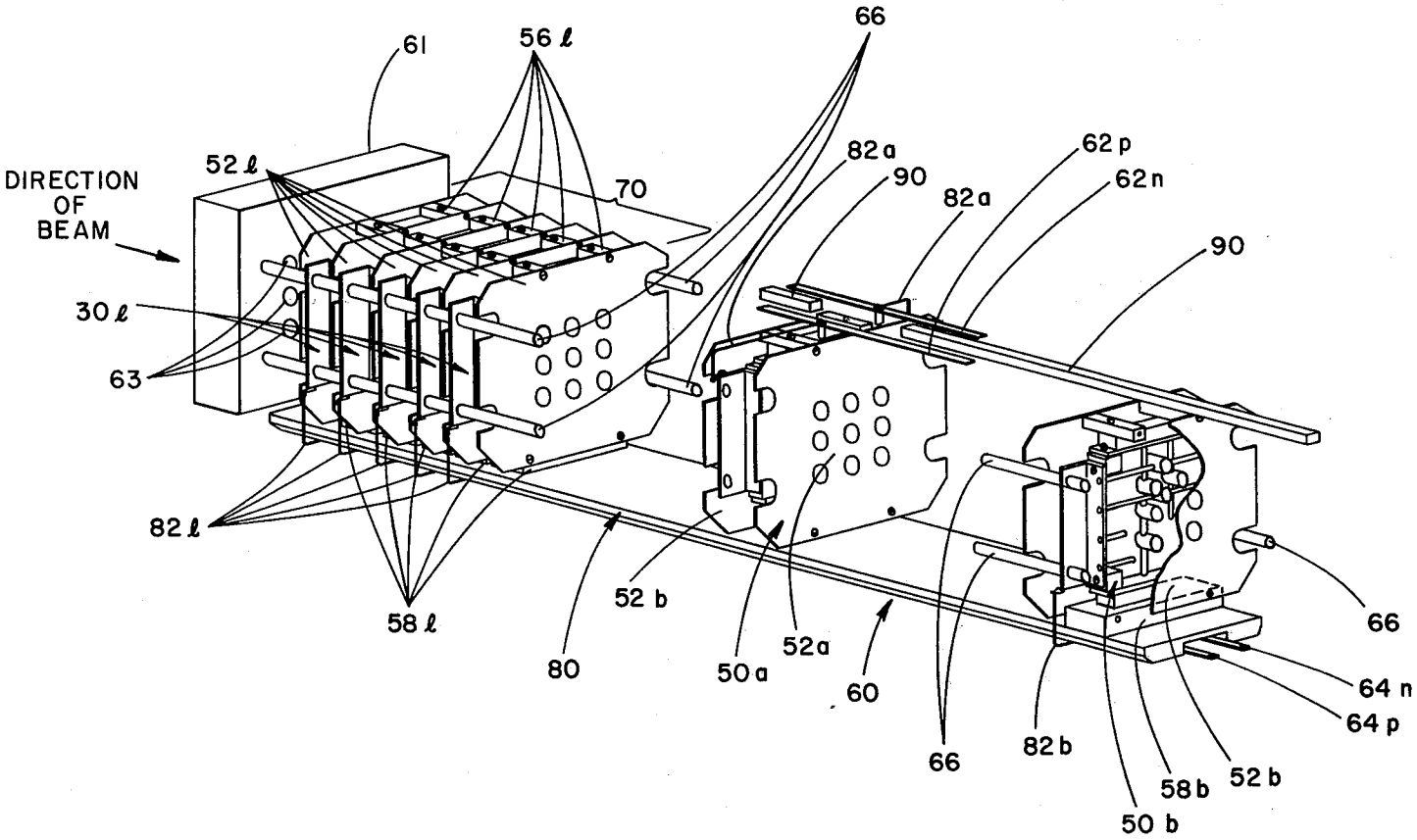
FIG. 5 is an isometric drawing, partially broken away, of a Linac assembly according to the present invention.

Turning now to FIG. 5 there is shown a Linac assembly 60 utilizing arrays 30 and drift tubes 50 of the subject invention which is suitable to accelerating singly charged xenon ions to an energy of approximately 56 keV above the injection energy. Array 60 is intended for use with conventional vacuum vessels (not shown for ease of illustration) and conventional ion source 100.

Starting from the injection end of assembly 60 the continuous beam from the ion source (100) is first prebunched by buncher 61. This prebunching improves the amount of beam captured.

In the embodiment shown in FIG. 5 buncher 61 consists of a metal plate approximately one-half a particle wavelength thick and having a plurality of holes slightly larger than, and aligned with, holes **52*a*. (By "particle wavelength" herein is meant the distance through which a particle moves in one RF cycle.) Buncher 61 is mounted on glass rods 66** and connected to a source of RF power. The magnitude of RF voltage necessary to obtain optimum bunching may be calculated from known principles by a person skilled in the linear accelerator art. The phase of the RF is then adjusted for maximum current.

The beam, which comprises a plurality of transversely spaced parallel beamlets, then enters low energy beam transport section (LEBT) 70. This LEBT 70 serves to isolate the ion source from the following RF sections which will be described below. LEBT 70 comprises five electrostatic quadrupoles arrays **30*l* which are separated by six plates 52*l*. Plates 52*l* are essentially identical to plates 52 used in the drift tubes 50 shown in FIG. 3. The five electrostatic quadrupoles 30***d* are mounted on and aligned by glass alignment rods 66. The plates 52*l* are mounted to quadrupoles 30*l* by insulating mountings 56*l* and by ground conductive blocks 58*l*. The conductive blocks 58*l* connect plates 52*l* to mounting frame 80 which also serves as an RF ground. Thus LEBT 70 comprises five equally spaced and aligned quadrupoles 30*l* which are separated by plates 52*l* so as to form a five section LEBT 70. Connections 82*l* to a first pair of DC busses (not shown) provide appropriate DC voltages to quadrupoles 30*l*. (Only connections to the horizontally mounted electrodes only are shown for ease of illustration.)

It has been found advantageous to operate LEBT 70 quadrupoles 30*l* at lower voltages then drift tube 50 quadrupoles 30 to allow for emittance mismatch between the ion source 100 and the accelerating section and since a somewhat higher voltage is needed on quadrupoles 30 to compensate for a slight defocusing effect caused by the RF accelerating voltage.

LEBT 70 thus provides an initial focusing of the beam without any acceleration and isolates the following RF powered drift tubes from the ion source.

Advantageously the quadrupoles for LEBT 70 may be formed from a plurality of identical components comprising metal plates having a plurality of apertures and projections. On one side of each plate a plurality of projections would be formed adjacent to the apertures positioned as the vertical electrodes of a quadrupole. On the other side of the plate a similar plurality of projections would be formed but would be positioned as horizontal electrodes. By mounting an array of such components in line, insulated from each other, so that the projections intermeshed a plurality of quadrupoles would be formed between each pair of plates. By connecting alternate plates to DC potentials of opposite polarity the array would comprise an LEBT.

LEBT 70 is followed by a first drift tube section 50*a*. Plates 52*a* of drift tube section 50*a* are connected (connections not shown) to RF buss 90. DC voltages (positive and negative) are supplied through connections 82*a* to the quadrupole of drift tube 50*a* by a second pair of DC busses 62*p* and 62*n*: DC busses 62*p* and 62*n* are used to provide DC to all RF powered drift tube sections. Drift tube 50*a* is mounted on and aligned by glass rods 66. Drift tube 50*a* is followed by a grounded drift tube 50*b*. (The spacing between drift tubes 50*a* and 50*b* is shown greatly exaggerated for ease of illustration.) Drift tube 50*b* is similar in all respects to drift tube 50*a* except that plates 52*b* are grounded to frame 80 by conducting mounting block 58*b*. DC voltages (positive and negative) for the quadrupole of drift tube 50*b* are provided through connections 82*b* by a third set of DC busses 64*p* and 64*n*. The quadrupole of drift tube 50*b* is again mounted on and aligned by glass rods 66.

The spacing between drift tubes 50*a* and 50*b*, and all other drift tubes, is determined by the mass and charged state of the ion to be accelerated and by the frequency and voltage of the RF power supply (not shown) according to principles that are well known by those skilled in the art of linear accelerator design. It has been determined that the theoretical optimum potential for the electrostatic quadrupoles 30*a* and 30*b* in a wide range of linac designs is approximately 0.115 times the injection energy (in electron-volts) of the particles. Empirically this potential is usually slightly higher in order to correct for the RF defocusing affect. Additional RF powered and grounded drift tubes (not shown) are provided to supply additional acceleration until the desired acceleration is reached.

The separate busses 62*p* and 62*n* for the RF powered drift tubes pass through the resonator coil of the RF power supply so that the potential on the electrodes is either + or − the DC potential with respect to plates 52*a*.

DESIGN GUIDES

The following relations are useful in designing embodiments of the subject invention in various applications. In the following:

k is defined as the ratio of space charge forces to restoring (focusing) forces. Experience and computer simulation indicate $k \simeq 0.5$ $k_3$ is the quadrupole radius ($r_o$) divided by the initial particle wave length ($\beta_o\lambda$). A reasonable value is 0.125.

$k_4$ is the quadrupole length divided by the number of particle wave length per focusing cell ($n\beta\lambda$). A reasonable value is 0.4.

$\mu_o$ is the phase advance per cell with zero space charge force. A reasonable value is 1.5.

$\eta$ is the ratio of the average radius of the beam envelope to the maximum radius ($r_{ave}/r_{max}$). A reasonable value is 0.707.

n is the number of half particle wave lengths measured from the center of one accelerating gap to the center of the next. In the apparatus above n=1. (It should be noted that other configuration having other values of n are well known in the accelerator art.)

A focusing cell is defined as two drift tubes each containing a quadrupole. The cell length ($L_c$)=the length of the two drift tubes plus two gap lengths.

Using the above definitions, and the above values where numerical values are given, the following relations hold:

where:

$E_{Qm}$=the pole tip field of the quadrupoles $\epsilon_{NT}$=the transverse acceptance of the machine $P_{6d}$=the six dimensional phase space density A=ratio of the particle mass to the proton mass $\beta$=ratio of the particle velocity to the velocity of light $\beta_o$=the initial $\beta$ f=the RF frequency z=the particle charge state The conditions for maximum $P_{6d}$ are $$\bar{E} \simeq 0.2\, E_{Qm} \text{ and}$$

$$\epsilon_{NT} \simeq \epsilon_{NL}$$

where:

$\bar{E}$=average accelerating field $\epsilon_{NL}$=the longitudinal acceptance of the machine For $\epsilon_{NT}=\epsilon_{NL}$ it is sufficient that:

$$\frac{fr_o}{\beta c} = k_3 \text{ and } E\cos\phi_s = \frac{0.5\,\mu_o^2\eta^{4/3}}{n^2}\,\frac{fA\beta}{z}$$

where:

c=velocity of light $\phi_s$=the stable phase angle (i.e., the phase of the RF at which the particles must enter the machine to maintain a constant phase at each accelerating gap.)

$r_o$=the quadrupole radius

If we introduce a parameter V such that zeV = the particle injection energy (i.e., V is the ion source extraction voltage.)

where:

e ≡ the electron charge then the following relations also hold:

$$i_{max} \approx 1.7 \times 10^{-8} \frac{V^{3/2} Z^{\frac{1}{2}}}{A^{\frac{1}{2}}}$$

$$\epsilon_{NT} \approx 1 \times 10^{-6} \frac{V^{3/2} Z^{\frac{1}{2}}}{E_{Qm} A^{\frac{1}{2}}}$$

$$r_o \approx 0.23\ V/E_{Qm}$$

$$V_Q = E_{Qm} r_o/2 \approx 0.115V$$

$$r_{max} \approx 7.5 \times 10^3 \frac{E_{Qm} Z^{\frac{1}{2}}}{V^{\frac{1}{2}} A^{\frac{1}{2}}}$$

While the linac of the subject invention will operate with a wide variety of ion sources, preferably a modern multiple apperture source will be used so that each apperture may provide a beamlet. For optimum performance the following relations should be satisfied:

$$TeV \leqq 0.18V$$

$$d \geqq 4.8 \times 10^8 \frac{E_{Q3m}}{z^{\frac{1}{2}} V} \text{ (meter)}^{-3}$$

where:

Tev ≡ the characteristic temperature of the source in electron volts.

d ≡ the plasma density in the source.

(Note units are MKS with E in volts/meter)

a. Experimental Example

A small experimental Linac (the M1 MEQALAC) has been constructed in accordance with the subject invention.

| | |
|---|---|
| Ion Accelerated | $Xe^{+1}$ |
| No. of Beams | 9 |
| Machine Type | Wideröe |
| Injection Energy | 15.5–17.3 keV |
| Output Energy | 71.5–73.3 keV |
| Input $\beta\lambda/2$ | 1.89 cm |
| Output $\beta\lambda/2$ | 3.95 cm |
| RF Frequency | 4 MHz |
| Peak RF Voltage | 5 kV |
| Accelerating Voltage | 3.5 |
| Stable Phase Angle | $\sim\sin^{-1}$ 3.5/5.0 45° |
| Nominal Quad Voltages | ±2 kV |
| Repetition Rate | 10 pps (arc supply ltd) |
| Pulse Length | 500 usec (arc supply ltd) |
| Pre-Buncher | $\beta\lambda/2$, 4 MHz, 1–1.5 kV |
| Nominal Vacuum | $10^{-5}$ torr |
| Gas Feed | Continuous |
| Calculated Avg. Current During Pulse - S.C.L. | 3.3 mA |
| Measured Current | 2.8 mA |

The acceleration assembly (similar to that shown in FIG. 5) is suspended in six inch Varian vacuum pipes. The ion source, operating at +15.5–17.3 kV DC, is shielded by a screen enclosure and isolated from the metal pipe by a 6 inch diameter×6 inch long Pyrex vacuum pipe. The vacuum pump is a Welsh Turbo-Torr 1500 l/sec unit and is mounted below a "cross" vacuum section. The upper port of the "cross" is used for quadrupole high voltage feedthrough. The forepump sits behind a panel with the circular ventilation screen.

The RF voltage is fed through the bottom of a "tee" section. The 4 MHz transmitter and tank circuit resonator are mounted separately. A Faraday cup is held on a rod inserted through a vacuum fitting on a Lucite end cover, and bias grid voltage and beam pickup connections are fed through the same cover.

A separate rack enclosure is provided for the ion source power supplies, controls, and cooling system.

The accelerator has a pre-buncher "tube" or plate. The buncher tank circuit resonator is mounted beneath the ion source screen enclosure. The pre-buncher RF is fed to the buncher tube through a Covar seal in the Pyrex pipe which isolates the ion source.

b. The Quadrupole—Drift Tube Configuration

FIG. 4 shows the quadrupole array. The poles are made of 5/16 inch diameter aluminum, and arranged for nine beams with 5/16 bore diameter. It was estimated that a 1% (~0.003 inch) tolerance was needed on the position of any pole tip. To accomplish this, the arrays were made on precision fixtures. ⅛ inch precision-ground steel rods are pinned to the frame and pole tips in the fixtures, thus avoiding thermal expansion problems had they been soldered. The insulators at the corners were made of Rexolite.

M1 had 8 drift tubes operating at RF potential, 7 drift tubes at ground potential, and 5 LEBT (Low Energy Beam Transport) quadrupole arrays, making 20 quad arrays in all. The LEBT and ground drift tubes are screwed to a steel alignment plate. This plate is hung from the top of the vacuum pipe. The RF drift tubes are suspended from ¼" Rexolite rods which run through the side plates attached to the quad arrays as seen in FIG. 3.

RF connections are made to a copper bus bar which runs at the bottom of the vacuum pipe. Near the RF bus are two busses for the ±DC quad voltages for the RF quads. The feed lines for these are run through the resonator coil. There are two busses above the accelerating assembly for the ±quad voltages for ground drift tubes. The complete assembly is shown in FIG. 5.

The LEBT quads have separate busses and are run from a separate power supply. In operation, they run at a lower potential for two reasons: (1) the LEBT quads must compensate for any emittance mismatch between the ion source and the accelerating section and (2) a small RF defocussing effect in the accelerating section is expected.

The accelerating section has 16 accelerating gaps. The drift tube table (Table II) is calculated for 3.5 keV energy gain at each gap. The quadrupole lengths are proportional to the velocity of the particle. It follows that the same phase advance/cell is maintained by having the same voltage on all of the accelerator quadrupoles. Thus, the M1 has a power supply which provides ±quad voltages for the accelerating section (with extra output connectors to feed the RF quads), and another which supplies ±voltage for the LEBT quadrupoles.

TABLE II

DRIFT TUBE TABLE

| Drift Tube NO | | Energy EV | Transit Time Factor | Particle Velocity M/S | Drift Tube Length CM | Drift Tube Length IN | Electrode Length CM | Electrode Length IN |
|---|---|---|---|---|---|---|---|---|
| G | 0 | 15500. | | 151262. | — | — | — | — |
| RF | 1 | 19000. | 0.913 | 166126. | 1.702 | 0.670 | 0.990 | 0.390 |

TABLE II-continued

| DRIFT TUBE TABLE | | | | | | | | |
|---|---|---|---|---|---|---|---|---|
| Drift Tube NO | | Energy Transit Particle EV | Time Factor | Velocity M/S | Drift Tube Length CM | IN | Electrode Length CM | IN |
| G | 2 | 22500. | 0.926 | 181192. | 1.890 | 0.744 | 1.080 | 0.425 |
| RF | 3 | 26000. | 0.935 | 195054. | 2.063 | 0.812 | 1.163 | 0.458 |
| G | 3 | 29500. | 0.943 | 207968. | 2.225 | 0.876 | 1.240 | 0.488 |
| RF | 5 | 33000. | 0.949 | 220108. | 2.376 | 0.936 | 1.312 | 0.517 |
| G | 6 | 36500. | 0.953 | 231600. | 2.520 | 0.992 | 1.381 | 0.544 |
| RF | 7 | 40000. | 0.957 | 242539. | 2.657 | 1.046 | 1.446 | 0.569 |
| G | 8 | 43500. | 0.961 | 253000. | 2.788 | 1.097 | 1.508 | 0.594 |
| RF | 9 | 47000. | 0.964 | 263040. | 2.913 | 1.147 | 1.568 | 0.617 |
| G | 10 | 50500. | 0.966 | 272708. | 3.034 | 1.194 | 1.626 | 0.640 |
| RF | 11 | 54000. | 0.968 | 282041. | 3.151 | 1.240 | 1.681 | 0.662 |
| G | 12 | 57500. | 0.970 | 291073. | 3.263 | 1.285 | 1.735 | 0.683 |
| RF | 13 | 61000. | 0.972 | 299831. | 3.373 | 1.328 | 1.787 | 0.704 |
| G | 14 | 64500. | 0.973 | 308339. | 3.479 | 1.370 | 1.838 | 0.724 |
| RF | 15 | 68000. | 0.975 | 316617. | 3.583 | 1.411 | 1.888 | 0.743 |
| G | | 71500. | | 324683. | | | | |
| Linac Length = 41.017 + 16 × 0.375 = 47.017 cm | | | | | | | | |

c. Ion Source, Match to LEBT, and Pre-Buncher

While the linac of the subject invention may be used with a large variety of conventional ion sources good experimental results were obtained with a version of the ion sources developed by Lawrence Berkeley Laboratory for the Controlled Threnonuclear Reactor Program. This type of source, with multiple distributed filaments in a chamber, produces a very quiet and uniform plasma. The electron efficiency is low, but when operated with xenon the filaments are long-lived even with cw filament operation for the modest current densities needed.

Typical operating parameters are:

TABLE III

| ION SOURCE PARAMETERS | |
|---|---|
| Fil voltage | 7.5 Vac |
| Fil current | 150 amps ac |
| Arc current | 25A |
| Arc voltage | 50V |
| Ion current density | 25 m/Acm$^2$ |

In operation, the filaments and gas run cw, and the arc voltage is pulsed. The current density is adjusted from 1–50 mA/cm$^2$ by varying the filament power.

Previous emittance measurements with this source yielded 25 mA of $Xe^{+1}$ into 10 cm-mrad at 15.5 keV. Although these measurements were performed under space-charge neutral conditions after the extraction gap, it is clear that a considerable degree of emittance "spoiling" is necessary to fill the transport channel.

We have found one special solution to this highly non-linear problem experimentally. The slits are cut in concave "dimples" of $1\frac{1}{4}$ inch radius in both the arc cover plate and grounded extraction plate. The area of the extraction hole is 0.35 cm$^2$, with an aspect ratio of 3:1. This gives us a converging beam in the dimension parallel to the slit, and a diverging beam in the direction perpendicular to the slit. We adjusted the quad channel position for maximum transported current, and obtained 2.4–2.6 mA of $Xe^+$ when the first quad end was $\frac{7}{8}$ inch from the extractor plate. For the highest current levels, it was found that the arc voltage should be raised to 70–80 volts.

In this case, the total current emerging from the extractor is ~8 mA, and we transport ~2.5 mA. We assume that the acceptance of the channel is well filled, but this has not been measured to date.

With a $\frac{7}{8}$"0 gap between the extractor plate and the first LEBT quad, we are able to insert a pre-buncher plate of $\frac{1}{2}$ inch thick aluminum. This has nine $\frac{1}{2}$ inch diameter holes and is suspended on the same Rexolite rods. The $\beta\lambda/2$ length between the centers of the buncher gaps is 0.75 inch.

The drift length from the buncher to the first RF gap is 4 inches (through five LEBT quad arrays). This drift length is sufficient to give a 45° phase shift with 1.5 kV buncher voltage.

The instantaneous bunch current has the same transverse spacecharge limit as the DC transport limit. Therefore, we have competing "bottlenecks" in the transport at each end of the LEBT. This was verified in operation of M1, by observing that the ion source could be run from 10–25 mA/cm$^2$ current density without changing the output current.

d. RF System

The RF system consists of two major parts; an amplifier and a resonator.

The amplifier is a 4 MHz, 2 stage, 700 watt linear amplifier with broadband interstage coupling. The input RF amplitude range is 0 to 1 volt peak, for an output power level from 0 to maximum. The amplifier is single-ended throughout the two output tubes driven in parallel. The input stage is operated in a class A mode with control grid modulation to compensate for beam loading. The interstage coupling is performed by a Tchebycheff filter so that tuning is unnecessary. The final stage tubes operate in a class $AB_1$ mode. This stage operates in a stable fashion with grid and screen parasitic suppressors but no neutralization. The RF plate connection is directed vertically and passes through a small duct into the resonator compartment normally mounted above.

The resonator is a three turn coil of $\frac{3}{4}$ inch copper tubing with a nine inch mean diameter. The amplifier plate connection is made at the first turn to give a step-up turns ratio of 1:3, thus providing 5 kV peak RF at the accelerating gaps. The unloaded Q of the resonator with the accelerating structure connected was measured at 680. The noload or tank and accelerating structure losses amount to 300 watts. The remainder of the output power is beam loading. The 3rd turn, or top of the coil has a flange to mate with a flanged bus from the accelerating structure just below a vacuum window. Two RG 58 coaxial cables for ±DC voltage for the RF quads can be seen entering the bottom coil mounting flange. They leave through the top mounting flange and thus have RF isolation. From the top of the resonator to ground is a 300 pF vacuum capacitor for final stage tuning. Below the tuning capacitor is a 1:1000 capacitive divider for monitoring the gap voltage.

The RF is switched at the oscillator and modulated at the first stage of the RF amplifier from timing pulses generated at the master timing panel.

The buncher is driven by a helical resonator and, in turn, driven by a commercially built wideband amplifier. The 4 MHz oscillator also provides the low level RF signal that drives the buncher amplifier. A separate RF amplitude control is provided, and a phase shifter is included so that the relative RF phase between the accelerating gaps and buncher may be tuned.

IV. M1 Operating Results

After running the M1 for several days, all systems were working together to produce good results under the conditions of Table IV.

TABLE IV

| OPERATING CONDITIONS | |
|---|---|
| Source | MEQUALAC |
| Fil Current: 133A | LEBT Quads: ±1.8 kV |
| Arc Current: 29A | Linac Quads: ±2.25 kV |
| Source Voltage: +17.3 kV | RF Voltage: 4.7 kV |
| | Buncher Voltage: 1.5 kV |
| Vacuum: $2 \times 10^{-5}$ torr | |

The output current of all nine beams was collected in a single Faraday cup with a −300 V biased grid. The signal was terminated in 1 kΩ with an integrating capacitor. The average current is 2.8 mA. There is about a 10% RF signal passing the integrator.

The instantaneous peak current per beamlet is 2.8 mA. We obtain an experimental RF filling factor from these two results of 11±1%. This is obtained by solving the relationship (2.8 mA/beam)×(9 beams)×(fill factor)=2.8 mA Total Avg. Current.

The error quoted is an estimate of several factors including different peak currents obtained for individual beamlets, which was probably due to the coarseness of the grid bias wires compared to the small beam sizes.

The operation of the quadrupoles was straightforward and troublefree. We measured 0.2 mA of current drain from the quad supplies during beam time.

At $V_{input}$=17.3 kV, $V_Q$ is ±2.0 kV. Our best results were obtained with $V_Q$=±2.25 kV. The theoretical estimate does not take into account the effect of RF defocusing.

An important consequence of the above quad voltage relationship is that the focussing channel can be arbitrarily close to the ion source extraction gap. That is to say, if the ion source operates without sparking at the extractor, then the channel shouldn't spark either. This is very favorable for further MEQUALAC development since improvement calls for smaller beams and higher ion source current densities.

The above detailed description, specific examples, and drawings are provided by way of illustration only and limitations on the scope of this invention are to be found only in the claims set forth below. In particular, it should be noted that other types of Linac, which also comprise drift tubes containing focusing devices and utilize RF accelerating voltages, are well known in the art and a person skilled in the art could readily make and use different embodiments of the Linac of this invention by incorporating the focusing apparatus of this invention in such types of Linacs.

It should also be noted that while the inventor of the present application is the sole inventor of planar arrays of electrostatic quadrupoles as described and claimed in the present application the particular improved embodiment shown in FIG. 3 was the independent invention of Mr. John Brodowski. As originally conceived by the present inventor each electrode of the planar array would have been individually mounted on stand-off insulators and individually connected to the appropriate DC polarity. While functional, such an arrangement is mechanically complex.

Mr. Brodowski was given the assignment of mechanically simplifying and improving the original conception of the present invention. The embodiment shown in FIG. 3 is the result of his independent efforts.

What is claimed is:

1. A planar array of electrostatic quadrupoles including a plurality of electrodes suitable for applying strong focusing forces to a plurality of transversely spaced parallel beams of charged particles, said array forming a unitary structure.

2. The array of claim 1 wherein at least one of the electrodes of at least one of said quadrupoles is shared by two of said quadrupoles.

3. The array of claim 2, wherein said electrodes are substantially cylindrical in shape and have a diameter approximately equal to the diameter of an aperture of said quadrupoles, the axes of said cylinders being arranged essentially parallel to the beams.

4. The array of claim 2 wherein said electrodes have a length along an axis parallel to said beams proportional to the velocity of the particles and inversely proportional to the magnitude of the focusing forces, so as to maintain uniform focusing with increasing particle velocity.

5. A drift tube assembly comprising:

(a) an array as claimed in claims 1, 2, 3, or 4, and (b) means for shielding said array from RF accelerating fields, said means having a plurality of apertures to allow the passage of a plurality of parallel beams of charged particles, said apertures being aligned with the apertures of the quadrupoles of said array whereby particles may be shielded from such RF field and subject to strong focusing by said quadrupoles as they pass through said drift tube.

6. An accelerating assembly comprising:

(a) a linear uniformly separated series of axially spaced drift tube assemblies as described in claim 5, the quadrupole arrays of adjacent drift tube assemblies having reversed DC potentials with respect to each other; and (b) means for generating an RF accelerating field in the gaps between said drift tube assemblies.

7. An accelerating assembly as described in claim 6 wherein there is a 180 degree difference in the phase of said RF fields at successive gaps, and the length of said drift tube assemblies is such that the distance measured from the center of one gap to the center of the next is essentially equal an odd number of half particle wave lengths.

8. An accelerating assembly as claimed in claim 7, wherein the length of the electrodes measured in particle wave lengths, of said arrays of said drift tube assemblies is equal to a fraction ranging about from 0.2 to 0.4 multiplied by the length of said drift tube assembly plus one gap width.

9. A Linac, comprising:

(a) an ion source;

(b) an accelerating assembly as described in claim 8;

(c) a low energy beam transport means for adapting the emittance of said source to the acceptance of said assembly, said transport means being positioned between said ion source and said accelerating assembly, (d) first power supply means for supply RF power to said accelerating assembly;

(e) second power supply means for supply DC to the electrodes of said quadrupoles; and (f) vacuum means for maintaining said ion source, accelerating assembly and low energy beam tansport in a vacuum.

10. The Linac of claim 9 wherein said low energy beam transport means comprises a linear array of electrostatic quadrupoles, said quadrupoles being equal in length, aligned with said accelerating assembly and being separated from each other by a conductive plate having a plurality of apertures aligned with the apertures of said quadrupoles whereby said beams are provided with a preliminary focusing so as to adapt the emittance of said ion source to the acceptance of said accelerating array.

11. The Linac of claim 10 wherein said low energy beam transport quadrupoles are operated at a lower voltage than said quadrupoles of said accelerating assembly.

12. The Linac of claim 11 wherein a buncher means for pre-bunching the ions from said ion source into bunches suitable for acceleration by said accelerating assembly is positioned between said ion source and said low energy beam transport means.

13. The Linac of claim 12 wherein said buncher means comprises a conductive plate approximately one-half particle wave length in thickness and having a plurality of apertures aligned with the apertures of said quadrupoles, said plate being connected to a source of RF power equal in frequency to the frequency of the accelerating RF and having predetermined voltage and phase relation to said accelerating RF.

14. A Linac wherein the improvement comprises providing within each drift tube assembly means for generating field configurations suitable for applying strong focusing forces to a plurality of transversely spaced parallel beams of charged particles in one direction orthogonal to said beams and strong defocusing forces in the other orthogonal direction, said focusing and defocusing forces being reversed, in adjacent drift tube assemblies, whereby a plurality of parallel accelerating channels is formed within said Linac.

15. The Linac of claim 14 wherein said field configurations are provided by planar arrays of electrostatic quadrupoles.

16. The Linac of claim 15 wherein said arrays comprise an electrode shared by two of said quadrupoles.

17. The Linac of claims 14, 15, or 16 wherein the average accelerating field between drift tubes is equal to 0.2 times the equivalent maximum focussing field within said drift tubes and the normalized longitudinal acceptance and normalized transverse acceptance of said Linac are approximately equal, whereby the maximum brightness of said Linac is optimized.

18. Means for focusing and maintaining beams of charged particles in spaced apart parallel relationship to each other comprising an array of transversely spaced positive and negative electrodes forming a different electrostatic quadrupole for each beam wherein each of said quadrupoles includes an electrode which forms a part of another one of said quadrupoles in the array.

19. A charged particle process comprising the steps of:

(a) generating a plurality of spaced apart parallel beams of charged particles;

(b) providing a focusing array of electrostatic fields transverse to the axes of said beams for applying strong focusing forces to the beams in one direction and strong defocusing forces to the beams in the orthogonal direction;

(c) providing a second focusing array of electrostatic fields next adjacent to the first fields along the axes of said beams and orthogonal to the first fields for applying strong focusing and defocusing forces to the beams at right angles to the forces of the first array.

* * * * *